United States Patent [19]

Petillo

[11] 4,128,033

[45] Dec. 5, 1978

[54] TAILPIECE

[76] Inventor: Phillip J. Petillo, 1206 Herbert Ave., Ocean, N.J. 07712

[21] Appl. No.: 812,102

[22] Filed: Jul. 25, 1977

[51] Int. Cl.[2] ..... G10D 3/12

[52] U.S. Cl. ..... 84/299; 84/297 R

[58] Field of Search ..... 84/290, 297 R, 298–302, 84/307, 313

[56] References Cited

U.S. PATENT DOCUMENTS 1,230,695 6/1917 Fickert ..... 84/298

2,029,135 1/1936 Stanley et al. ..... 84/298

2,573,254 10/1951 Fender ..... 84/307 X

FOREIGN PATENT DOCUMENTS 905447 9/1962 United Kingdom ..... 84/313

*Primary Examiner*—Lawrence R. Franklin

*Attorney, Agent, or Firm*—Roger A. Clapp

[57] ABSTRACT

A unitary tailpiece is disclosed which supports a bridge assembly and which has top accessed sockets and slots adapted to anchor and hold the strings in proper position on a stringed instrument.

4 Claims, 6 Drawing Figures

TAILPIECE

BACKGROUND OF THE INVENTION

1. Field of the Invention

This invention relates to accessories for stringed instruments and pertains in particular to tailpiece and bridge assemblies.

2. Description of the Prior Art

Stringed instruments such as guitars and the like require an anchoring point and a bridge assembly to support and hold the strings. Typically, the anchoring point is called a tailpiece and is rigidly attached to the instrument. Many types of tailpiece are available but the usual construction often causes unnecessary string wear.

Accordingly, one object of this invention is to reduce string wear in the anchoring portion of the tailpiece.

Strings often break during use and must be replaced. Replacement, however, has typically been complicated and inconvenient. The reason is that most tailpieces adapted to accept replacement springs are difficult to use.

Accordingly, another object of this invention is to facilitate string replacement in a tailpiece which is simple and easy to use.

SUMMARY OF THE INVENTION

In accordance with a preferred embodiment of this invention, slots and sockets for conveniently accommodating instrument strings are combined with a seat for supporting a bridge assembly and a framework for accomodating an adjusting mechanism adapted to regulate the position of the bridge assembly to form an easy to use unitary tailpiece assembly.

In accordance with one feature of this invention, the tailpiece slots have bearing surfaces lying substantially in the plane of the strings when they are installed so as to reduce string wear.

In accordance with another feature of this invention, the sockets and slots in the tailpiece are open from above to facilitate string installation.

In accordance with another feature of this invention, the tailpiece assembly simultaneously anchors the strings and accommodates the bridge assembly to simplify and facilitate use.

These and other objects and features of this invention will be more readily understood by reference to the following detailed description and drawing.

DETAILED DESCRIPTION OF THE INVENTION

Figure 1:
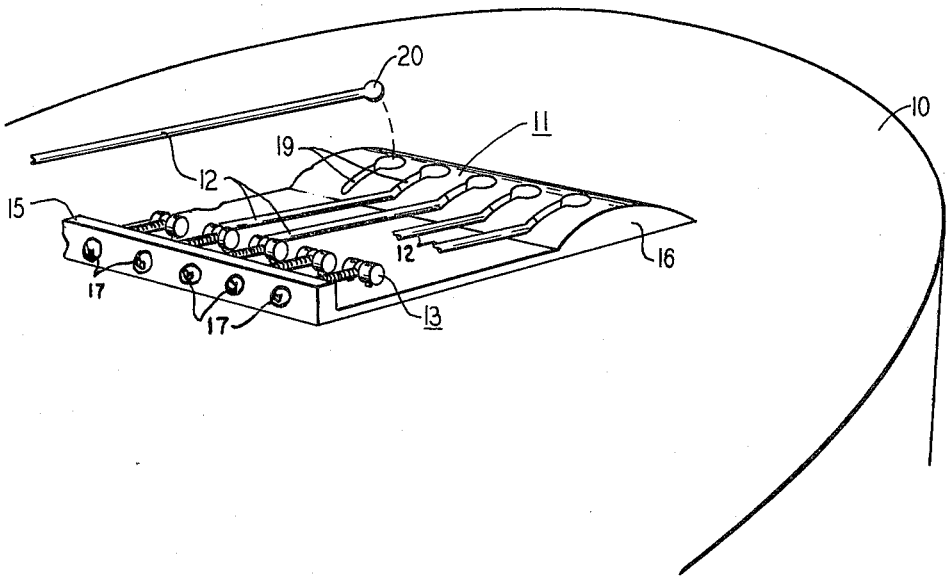
FIG. 1 is a perspective view of a portion of a stringed instrument accomodating multiple strings, a bridge assembly and a portion of a tailpiece made in accordance with this invention.

Referring to FIG. 1, a portion of the stringed instrument such as a multiple string guitar 10 is disclosed which has attached thereto a tailpiece assembly 11, five strings 12 and a bridge assembly 13.

Figure 3:
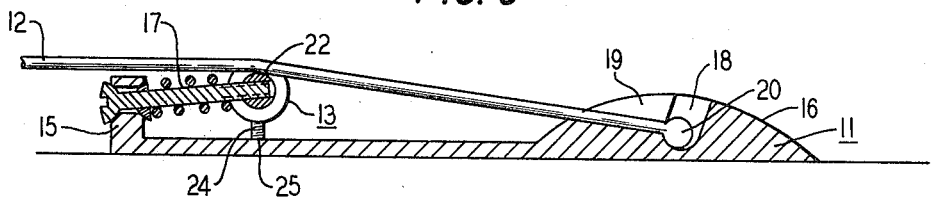
FIG. 3 is a side elevation view of the tailpiece portion shown in FIG. 2 taken in section along the line 3—3.
Figure 2:
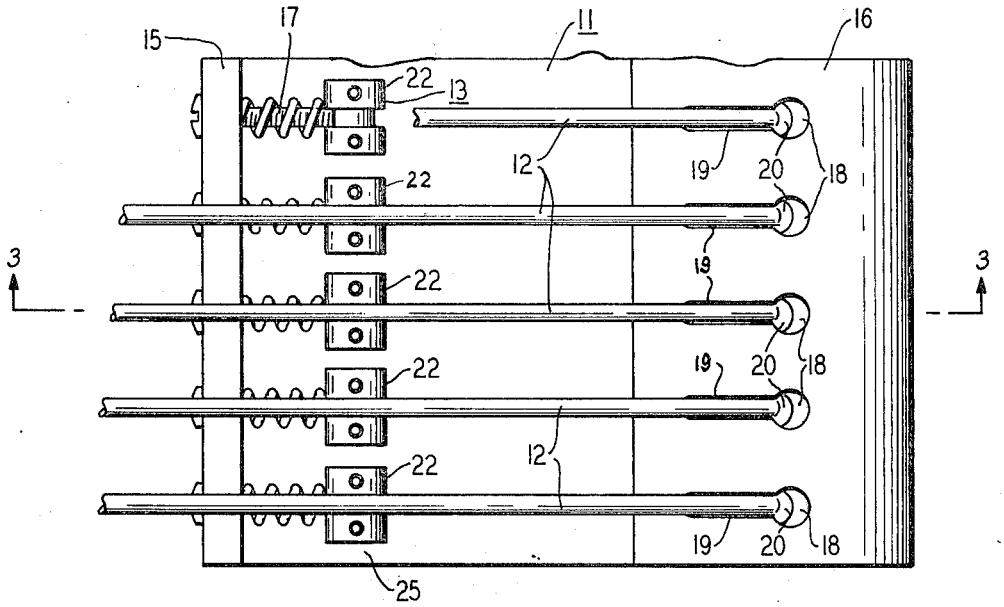
FIG. 2 is a plan view of the tailpiece portion shown in FIG. 1.

The tailpiece assembly 11, as best seen in FIGS. 2 and 3, is a unitary structure and may advantageously be formed of any strong and solid material such as plastic, steel, brass or the like. One end includes a foot 15 and the other is raised to form a shoulder or boss 16. The foot 15 is advantageously bent up from the body of the tailpiece assembly 11 and is perforated to form a framework suitable for accommodating multiple lateral adjusting rods 17. The shoulder 16 advantageously has a raised and curved top section perforated with a system of sockets 18 and slots 19. As best seen from FIG. 1 and 3, each string 12 terminates in an anchor knob 20 and each socket 18 has a diameter large enough to accommodate a knob 20. Moreover, each slot 19 is wide enough to accommodate the diameter of a string 12 including any terminating wrapping near the associated knob 20. The sockets 18 and the slots 19 communicate directly with the space above the tailpiece. Consequently, the strings can be inserted directly from the top without the need for threading string ends or the like.

Figure 4:
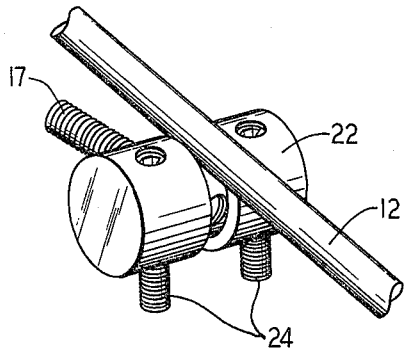
FIG. 4 is a perspective view of an element of the bridge assembly shown in FIG. 1.

In the embodiment illustrated in FIG. 2, the bridge assembly 12 includes elements or cylinders 22 aligned in a substantially coincident row. The cylinders 22 are of conventional construction and, as shown in FIG. 4, each comprises a solid body 22 made of plastic, wood or the like and three apertures occupied by a lateral adjusting rod 17 and two vertical adjusting rods 24. In the embodiment shown, the apertures are all tapped and two are disclosed at right angles to the third. The lateral and vertical adjusting rods 17 and 24 are threaded to fit the apertures and are also made of a strong material such as plastic, metal or the like. As best seen in FIG. 3, the rods 24 are vertically disposed with respect to the tailpiece assembly 11 and rest on a mid-portion or seat 25. Similarly, the rods 17 are laterally disposed and engage the foot 15 so as to link the cylinders 22 to the tailpiece assembly 11.

Figure 5:
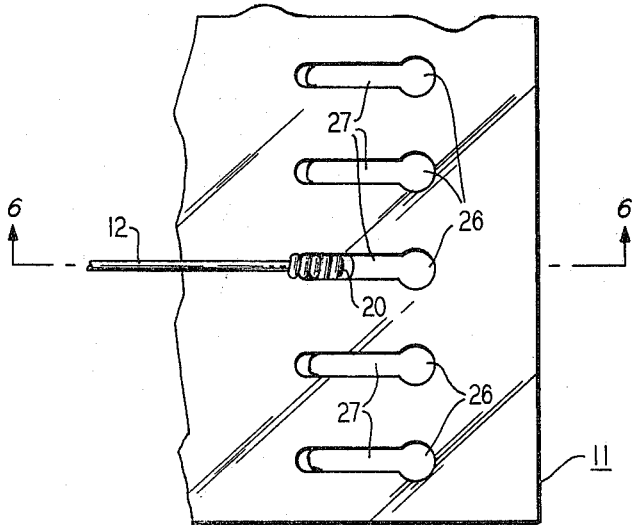
FIG. 5 is a partial plan view of the tailpiece portion shown in FIG. 1 in which an alternate form of anchoring arrangement is illustrated.
Figure 6:
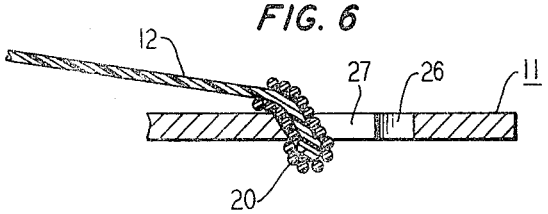
FIG. 6 is a side elevation view of the tailpiece portion show in FIG. 5 taken in section along the line 6—6.

An alternate form of tailpiece, as shown in FIG. 5, has sockets 26 and slots 27 which are let into the base of the tailpiece assembly 11 as opposed to the socket, slots and boss arrangement previously described. As best seen in FIG. 6, the slots 27 can be angled to further avoid sharp pressure points on the strings 12. More particularly, the angled portions of the slots 27 are advantageously directed so as to lie substantially in a plane containing the strings when they are installed on the instrument.

In use, the strings 12 are attached to the tailpiece assembly 11 by inserting the knobs 20 into the appropriate sockets 18 or 26. When the knobs 20 are properly inserted, the strings 12 will lie in the corresponding slots 19 or 27. When the strings 12 are installed, little angle will occur between the strings 12 and the edge of the appropriate slots. Consequently, pressure on the strings will be disbursed over a relatively long section thereof and will be limited to the portion of the strings where the end or knob winding is situated. As a result, a double thickness of string material is present to retard breakage. Consequently, string wear is avoided even when the position of the bridge assembly 13 is adjusted by activating the rods 17, 24 or both.

In summary, a tailpiece assembly has been disclosed in which strings are readily replaced, string wear is reduced and in which the tailpiece assembly is simple and easy to use. While only one embodiment of the invention has been disclosed, it is merely illustrative of the principles of the invention and many other embodiments falling within the scope of the invention will readily occur to those skilled in the art.

What I claim is:

1. In a mechanism for anchoring strings on a stringed instrument, the combination comprising:

a bridge assembly including support means for holding said string, lateral adjusting means for positioning said support means parallel to the surface of said instrument and vertical adjusting means for positioning said support means vertically with respect to the surface of said instrument, and a tailpiece assembly including anchoring means for fixing the ends of said strings with respect to said instrument, said anchoring means including a raised shoulder which is massive in cross section and is perforated by a plurality of generally upwardly directed, communicating slots-and-socket pairs wherein each slot defines a string bearing ramp and each socket is adapted to anchor a string, frame means for supporting said lateral adjusting means and seat means for supporting said vertical adjusting means, said seat means rigidly joining said anchoring and frame means to form a single unitary structure.

2. The combination in accordance with claim 1 wherein said ramps angle upwardly through said shoulder with respect to said seat member to form an extensive holding surface.

3. The combination in accordance with claim 2 wherein said unitary structure is formed of brass to impart substantial vibration damping characteristics to said tailpiece assembly.

4. The combination in accordance with claim 3 wherein said bridge assembly is located beneath an intermediate portion of said strings whereby said lateral adjusting means is located forward of said shoulder.

* * * * *